United States Patent [19]

Pieri et al.

[11] Patent Number: 4,725,757

[45] Date of Patent: Feb. 16, 1988

[54] COLOR TELEVISION TUBE INCORPORATING CORRECTION OF COMA DEFECTS OF SMALL AMPLITUDE

[75] Inventors: Roger Pieri, Autun; Jacques Baudry, Ecully, both of France

[73] Assignee: Videocolor, Montrouge, France

[21] Appl. No.: 893,452

[22] Filed: Aug. 7, 1986

Related U.S. Application Data

[63] Continuation of Ser. No. 599,877, Apr. 13, 1984, abandoned.

[30] Foreign Application Priority Data

Apr. 18, 1983 [FR] France ..... 83 06312

[51] Int. Cl.[4] ..... H01J 79/51; H01J 79/76

[52] U.S. Cl. ..... 313/413; 313/412

[58] Field of Search ..... 313/409, 412, 413, 414, 313/431

[56] References Cited

U.S. PATENT DOCUMENTS

| | | | |
|---|---|---|---|
| 4,142,131 | 2/1979 | Ando et al. | 315/368 |
| 4,225,804 | 9/1980 | Bekaert et al. | 313/412 |
| 4,370,593 | 1/1983 | Sweigart et al. | 313/414 |
| 4,457,733 | 7/1984 | Gioia et al. | 313/412 X |

FOREIGN PATENT DOCUMENTS 3126344 2/1983 Fed. Rep. of Germany .

OTHER PUBLICATIONS

Patents Abstracts of Japan, vol. 6, No. 160, (E-126), (1038), Aug. 21, 1982 & JP A 57 80640, 20-05-1982.

*Primary Examiner*—David K. Moore
*Assistant Examiner*—K. Wieder
*Attorney, Agent, or Firm*—Pollock, VandeSande & Priddy

[57] ABSTRACT

A color tube of the automatic convergence kind comprises three coplanar electron beams, with magnetic coma defect correction elements situated to the rear of the deflector unit. For the case where these defects are of small size, of the order of 1 mm or less in each direction, and of opposite sense in the horizontal and vertical directions, the correcting elements are formed by four plates of rectangular shape and whose plane is perpendicular to the axis of the tube. The plates are situated above and below each of the lateral beams and one dimension of each of the plates affects the amplitude of the correction in one direction, and the other dimension affects the coma correction in the other direction.

6 Claims, 6 Drawing Figures

COLOR TELEVISION TUBE INCORPORATING CORRECTION OF COMA DEFECTS OF SMALL AMPLITUDE

This application is a continuation of application Ser. No. 599,877, filed Apr. 13, 1984, now abandoned.

BACKGROUND OF THE INVENTION

The invention relates to a visual color display tube, particularly for television, with three coplanar electron beams and of the self convergent type.

In this context, the term "tube" denotes the system formed by the tube as such, the deflector unit and the electron beam generators.

It is known that in the case of television, or more commonly stated of visual display, color pictures are normally obtained by means of a screen coated with luminescent substances having three primary colors, commonly being red, green and blue, which are excited by three electron beams, of which one is provided for each color. These beams converge on the screen and are displaced along lines extending from left to right and from top to bottom.

The screen comprises triads, that is to say groups of three dots of substances luminescent in three colors The luminous intensity (luminance) and the color of each dot of the image which is to be reproduced are obtained by means of the excitation intensity of each of the elements of the triad.

In order that each electron beam may impinge only on the dots having the color to which it is allotted, the three beams have different directions on the one hand, and a perforated mask (shadow mask) is placed in front of the screen on the other hand.

The displacement of the beams along the lines, which is referred to as scanning, is effected by means of two variable magnetic fields which deflect the beams in the horizontal direction in the case of the one, and in the vertical direction in the case of the other. These magnetic fields are generated by electrical currents of variable intensity flowing in coils referred to as deflectors.

So that the three beams may attain convergence at all points of the screen, the magnetic field traversed by these beams must have a non-uniform and particular spatial configuration which is related in particular to the rectangular and substantially plane shape of the screen and to the coplanar arrangement of the beams.

If the convergence is obtained solely by virtue of the pattern of the magnetic field, the tube is referred to as being automatic or self convergent.

This automatic convergence is primarily effected due to the form of the windings of the deflector unit. However, the structure of the coils is commonly inadequate and convergence errors normally persist. One of these faults is so-called coma, which is manifested in a tube having coplanar beams, by the dimensions of the image produced by the central beam (commonly for green) which differ from the dimensions of the image produced by the lateral beams (red and blue). This fault is measured by the distance separating two adjacent vertical edges of the gren and blue images, and by the distance separating two adjacent horizontal edges of these images.

For correction of the coma fault it is known, for example from French patent No. 2,425,146, to provide elements of high magnetic permeability behind the deflector, that is to say at the side of the electron guns, in arrangements and configurations such that the magnetic field generated by the deflector is modified in a sufficient degree to perform the correction.

The invention relates to the case in which the coma defect is of small size, that is to say of the order of one millimeter or less, and of different sense in the horizontal (east-west) and vertical (north-south) directions, the (green) image produced by the central beam being wider for example than the image produced by the lateral beams (red-blue), but of smaller height than that of this image produced by the lateral beams.

The invention derives from the discovery that the magnetic coma correction elements known until now are inappropriate for correction of a defect of this kind.

In particular, in French patent No. 2,425,146 referred to above, the magnetic elements are formed by magnetic members applied to the bottom of a cupel forming an output electrode of the electron guns, and which thus has three openings for passage of the beams, two of these members having the form of crowns or rings surrounding the openings provided for the lateral beams, two other members being elongated vertical bars situated to either side of the opening for the central green beam. These magnetic elements are appropriate for coma defects of large size, of 5 mms for example, but they provide an excessive correction value for defects of lesser size thus causing a fault in the other direction.

SUMMARY OF THE INVENTION

The tube in accordance with the invention is characterized in that the magnetic coma correction elements which consist of flat members with their plane perpendicular to the direction of the beams, are formed by four rectangular members which are all preferably identical, associated with the lateral beams, two of these members being placed beneath these respective beams, and the two other members being placed above these same beams, the length and the width of each member being selected as a function of the respective coma defect values in the vertical and horizontal directions which are to be corrected.

The defect correction is consequently performed in a particularly simple manner. Furthermore, the correction means (or method ) is easily adaptable from one kind of tube to another, since the length of each rectangular element is a direct function of the height of the coma defect which is to be corrected, and similarly, the width of each element is a direct function of the size of the coma defect in the horizontal direction.

Moreover, the horizontal scanning sensitivity is increased, since with the magnetic correction elements according to the invention the horizontal magnetic deflection field is intensified in particular for the lateral beams, whereas the correction elements known until now reduce the sensitivity of the horizontal scan, that is to say require a higher intensity of supply for the deflectors.

BRIEF DESCRIPTION OF THE DRAWINGS

Other features and advantages of the invention will appear from the following description of some embodiments, given with reference to the accompanying drawings, in which.

DESCRIPTION OF THE PREFERRED EMBODIMENTS

Figure 1:
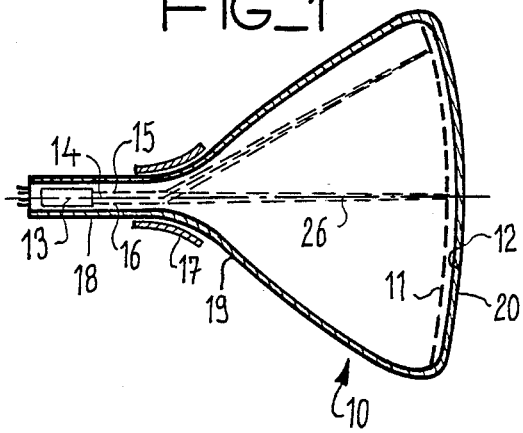
FIG. 1 is a diagrammatic cross-section of a color television tube of the kind comprising a perforated mask.

In this example, the color television tube 10 is of the kind comprising a perforated mask 11 situated within the tube in front of the screen 12, and electron guns 13 generating three coplanar beams 14,15 and 16. In this example, the central beam 14 is that which is intended to excite the green phosphor on the screen, whereas the lateral beams 15 and 16 excite the blue and red phosphors, respectively.

The displacement of these beams for scanning the screen 12 is performed by energizing horizontal and vertical deflection coils 17 which generate magnetic fields permitting the displacement of the three beams 14,15,16 respectively in horizontal and vertical directions.

The guns 13 are situated at the rear of the tube, within the cylindrical section 18 referred to as the neck. The deflection coils 17 are arranged partly around the neck 18 and partly around the flared section 19 connecting the neck 18 to the glass plate 20 providing the screen 12.

Figure 2:
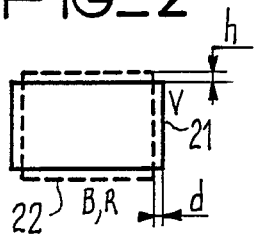
FIG. 2 is a diagram showing the result of the coma defect on the screen of the tube of FIG. 1.

The deflector 17 assures automatic convergence in practice, that is to say, the convergence of the three beams 14,15,16 throughout the screen. However, the coma defect persists, made apparent on the screen (FIG. 2) by different dimensions of the images generated by the three beams. Thus, the green central beam V14 produces a rectangular image 21 whereas the blue B and red R lateral beams produce an image 22, which is equally rectangular but narrower and higher than the image 21. The vertical sides of the image 22 are thus situated between the vertical sides of the image 21, the distance d between two adjacent vertical sides of the images 21 and 22 being of the order of 0.3 mm in this example (tube where the diagonal measurement of the screen is 51 cms), and the horizontal sides of the image 21 are situated between the horizontal sides of the image 22, the distance h between two adjacent horizontal sides being of the order of 0.8 mm in this example.

Figure 3:
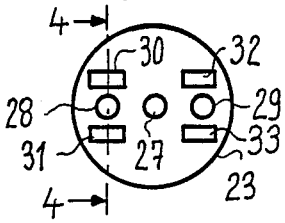
FIG. 3 shows the elements for correction of the defect of FIG. 2.
Figure 4:
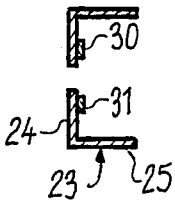
FIG. 4 is a cross-section along the line 4—4 of FIG. 3.

To correct the coma defects, the magnetic field behind the deflector 17, that is to say on the side of the guns 13, is modified. For this purpose, use is made of pellets or small plates of high magnetic permeability which are carried by the end electrode 23 (FIGS. 3 and 4) of the guns, that is to say the electrode facing towards the screen 12. This electrode 23 has the form of a cup with a cylindrical rim 25 and a base 24 perpendicular to the axis 26 of the tube. This base is pierced by three holes or openings with coplanar axes situated in a plane passing through the horizontal axis of the screen. The central hole 27 is intended for passage by the green beam 14, whereas the lateral holes 28 and 29 allow passage of the blue beam 15 and red beam 16. The magnetic elements are welded to the base 24 of the cup 23. They are formed by strips of an iron-nickel alloy.

In accordance with the invention, four rectangular small plates 30,31,32,33 (produced from an anhysteric material containing 48% of nickel) are provided above and below the openings 28 and 29. The rectangular plate 30 is positioned above the opening 28 with its long side $30_1$ horizontal, the center of this long side $30_1$ being aligned on the axis of the hole 28 intended to allow passage of the beam for excitation of the blue phosphors. In other words, the center line of the side $30_1$ passes through the center of the hole 28. The plate 31 is situated below the hole 28, in a position symmetrical to the plate 30 with respect to the center of the hole 28.

The plate 32 is positioned with respect to the hole 29, in the same way the plate 30 is positioned with respect to the hole 28. Similarly, the plate 33 is positioned with respect to the hole 29 in the same way as the plate 31 is positioned with respect to the hole 28.

In this example, the distance between the axis the hole 27 and the axis of the hole 28 or 29 is 5.1 mms, and the thickness of the plates is 0.25 mm. The length A of each of these plates, meaning the dimension in the horizontal direction, amounts to 3.8 mm, whereas its width, meaning the dimension in the vertical direction, is L=1.75 mm.

Figure 5:
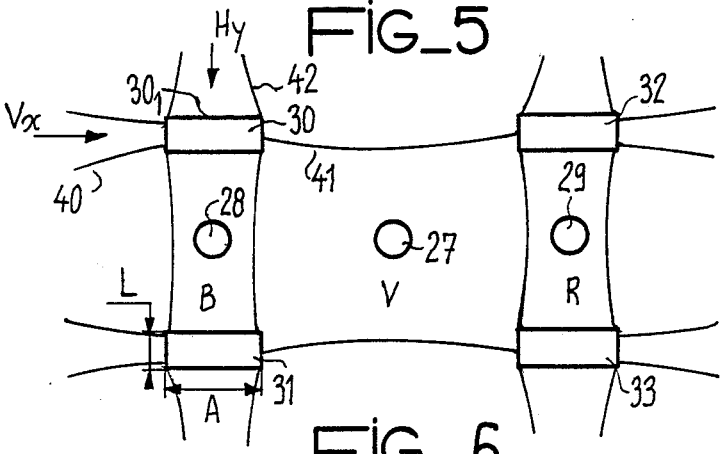
FIG. 5 is a diagram similar to that of FIG. 3, but to an enlarged scale, showing the action of the correcting elements on the magnetic deflection fields.

As shown in FIG. 5, the lines 40 of the vertical deflection magnetic field Vx are separated from each other around the holes 28 and 29. The vertical deflection magnetic field is consequently attenuated for the blue-red image. On the contrary, the lines 41 of the vertical deflection field are closer to each other around the hole 27. The vertical deflection magnetic field is thus intensified for the green excitation beam 14. The correction is consequently obtained in the direction required, namely increase of vertical deflection for the green color and reduction of the vertical deflection for the blue and red colors.

FIG. 5 equally shows that the field lines 42 for horizontal deflection Hy are closer to each other around the holes 28 and 29. These horizontal deflection field lines are equally close to each other around the hole 27, but to a lesser degree. The horizontal magnetic deflection field is consequently intensified for the three excitation beams, but it is more highly intensified for the blue and red phosphors than for the green phosphor. The result sought after is equally obtained, that is to say a relative reduction of the horizontal deflection for the green beam as compared to the horizontal deflection for the blue and red beams.

It has been observed however that the height correction of the coma defect (h, FIG. 2) depended primarily on the dimension A of the plates and that the width correction of the coma defect (d, FIG. 2) depended primarily on the dimension L. For a particular deflector unit having given defects d and h, it is therefore easy to select the dimensions A and L of the plates 30,31,32,33.

Figure 6:
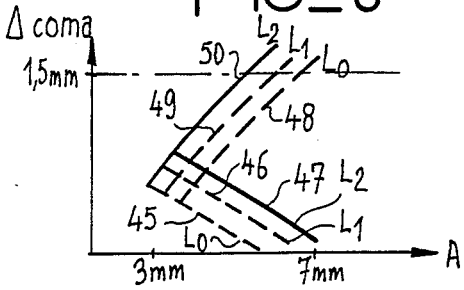
FIG. 6 is a graph showing the effect of the dimensions of the correcting elements of FIG. 3 on the coma defect.

Regarding selection of the dimensions A and B, it is possible to resort to the curves of FIG. 6 wherein the dimension A of a plate has been plotted as an abscissa, and the coma defects Δ have been plotted as ordinates (d or h).

The curves 45,46 and 47 are curves of variation of the horizontal coma defect d as a function of the dimensions A for three dimensions L, having values $L_o$, $L_1$ and $L_2$, respectively.

The curves 48,49 and 50 are similar to the respective curves 45,46 and 47, but for the vertical coma defect h.

The horizontal deflection magnetic field Hy being intensified for the entirety of the three beams, and more particularly for the two lateral beams, the plates in accordance with the invention make it possible to reduce the power supplied to the horizontal deflection coils. In other words, contrary to previous proposals, the correction is not effected at the detriment of the horizontal scanning sensitivity.

Although the long side of the plates 30 to 33 is horizontal in the example described in the foregoing, it should be noted that by way of modification, these long sides may have other directions, that is to say may be oblique with respect to the horizontal. Moreover, these long sides are not necessarily all mutually parallel.

The elements 30 to 33 are preferably simple plates without extension along the axis 26.

We claim:

1. In a color cathode ray tube a convergence electrode having a substantially flat base and a central aperture bounded on both sides by laterally outward apertures, all the apertures aligned along a common diametrical line for respectively passing a corresponding electron beam therethrough in the presence of horizontal and vertical deflection fields and means for correcting for coma of about 1 mm or less consisting essentially of:

a first pair of magnetic substantially identically shaped planar thin plates symmetricaly fastened to the base on opposite sides of a first laterally outward aperture, equidistant from the central aperture;

a second pair of magnetic planar thin plates shaped substantially identical to the first pair and symmetrically fastened to the base on opposite sides of a second laterally outward aperture, equidistant from the central aperture;

the plates disturbing the vertical deflection field, in the vicinity of the apertures, to achieve a change in the vertical deflection field flux density at the center aperture opposite to the change occurring in the vertical deflection field density at the outward apertures;

the plates further disturbing the horizontal deflection field, in the vicinity of the apertures, to achieve a greater flux density change in the vicinity of the outward apertures than the center apertures;

whereby the changes to the horizontal and vertical deflection fields results in correction of coma defects of about 1 mm or less.

2. The structure set forth in claim 1 wherein the magnetic thin plates have longitudinal axes that are mutually parallel.

3. The structure set forth in claim 1 wherein the magnetic thin plate have longitudinal axes that are not mutually parallel.

4. The structure set forth in claim 1 wherein variation of a first dimension of the plates effects change only in the amplitude of the correction in a first corresponding direction; and further wherein variation of a second dimension of the plates effects a change only in the amplitude of the correction in a second corresponding direction.

5. A method for correcting coma defects of about 1 mm or less in a color cathode ray tube equipped with a convergence electrode having a substantially flat base and a central aperture bounded on both sides by laterally outward apertures, all the apertures aligned along a common diametrical line for respectively passing a corresponding electron beam therethrough in the presence of horizontal and vertical deflection fields, the method consisting of the steps of:

symmetrically fastening a first pair of magnetic substantially identically shaped and planar thin plates to the base on opposite sides of a first laterally outward aperture, equidistant from the central aperture;

symmetrically fastening a second pair of magnetic planar thin plates, shaped substantially identical to the first pair, to the base on opposite sides of a second laterally outward aperture, equidistant from the central aperture;

the distribution of the magnetic plates -

(a) disturbing the vertical deflection field, in the vicinity of the apertures, to achieve a change in the vertical deflection field flux density at the center aperture opposite to the change occurring in the vertical deflection field density at the outward apertures; and (b) further disturbing the horizontal deflection field in the vicinity of the apertures, to achieve a greater flux density change in the vicinity of the outward apertures than the center aperture;

whereby the changes to the horizontal and vertical deflection fields results in correction of coma defects of about 1 mm or less.

6. The method set forth in claim 5 wherein a first dimension of the plates is selected to effect a change only in the amplitude of the correction in a first corresponding direction; and further wherein a second dimension of the plates is selected to effect a change only in the amplitude of the correction in a second corresponding direction.

* * * * *